US006685441B2

(12) United States Patent
Nam

(10) Patent No.: US 6,685,441 B2
(45) Date of Patent: Feb. 3, 2004

(54) SCROLL COMPRESSOR

(75) Inventor: Tae-Hee Nam, Changwon (KR)

(73) Assignee: LG Electronics Inc. (KR)

( * ) Notice: Subject to any disclaimer, the term of this patent is extended or adjusted under 35 U.S.C. 154(b) by 40 days.

(21) Appl. No.: 10/174,468

(22) Filed: Jun. 17, 2002

(65) Prior Publication Data

US 2003/0035736 A1 Feb. 20, 2003

(30) Foreign Application Priority Data

Aug. 20, 2001 (JP) ..... 2001-50046

(51) Int. Cl.[7] ..... F04B 49/00
(52) U.S. Cl. ..... 417/292; 417/310; 236/92 C
(58) Field of Search ..... 417/292, 307, 417/310, 440; 236/92 C

(56) References Cited

U.S. PATENT DOCUMENTS

| | | | | |
|---|---|---|---|---|
| 1,972,171 A | * | 9/1934 | Spencer | 236/92 C |
| 4,560,330 A | * | 12/1985 | Murayama et al. | 417/310 |
| 5,248,244 A | * | 9/1993 | Ho et al. | 417/292 |
| 5,263,643 A | | 11/1993 | Wells et al. | |
| 5,527,158 A | * | 6/1996 | Ramsey et al. | 417/292 |
| 5,690,475 A | | 11/1997 | Yamada et al. | |
| 5,707,210 A | | 1/1998 | Ramsey et al. | |
| 6,419,457 B1 | * | 7/2002 | Seibel et al. | 417/307 |

FOREIGN PATENT DOCUMENTS

| | | | |
|---|---|---|---|
| EP | 0 900 939 | | 3/1999 |
| JP | 6-26472 | * | 2/1994 |

OTHER PUBLICATIONS

Patent Abstract of Japan, vol. 2000, No. 03, Mar. 30, 2000 & JP 11 343994A (Fuji Robin Ind. Ltd), Dec. 14, 1999, Abstract, Figures 3, 5–7.

Patent Abstracts of Japan, vol. 1995, No. 04, May 1995 & JP 07 027068 A (Toshiba Corp.), Jan. 27, 1995, Abstract, Figures 3A, 3B.

* cited by examiner

*Primary Examiner*—Michael Koczo
(74) *Attorney, Agent, or Firm*—Ostrolenk, Faber, Gerb & Soffen, LLP

(57) ABSTRACT

A scroll compressor of simple structure and low production cost which can be protected when abnormal pressure state or abnormal temperature state of the compressor comprises: a sealed casing including a first chamber for forming a low pressure and a second chamber for forming a high pressure which are divided by a separating panel; a driving unit built in the casing for generating a driving force; a compressed unit connected to the driving unit via a rotating shaft for compressing and discharging fluid when the driving unit is operated; and a protecting device mounted on one side of the separating panel for bypassing the fluid of high pressure or of high temperature in the second chamber to the first chamber when a pressure difference or temperature difference between the first and second chambers is larger than a set value.

9 Claims, 7 Drawing Sheets

SCROLL COMPRESSOR

BACKGROUND OF THE INVENTION

1. Field of the Invention

The present invention relates to a scroll compressor, and particularly, to a scroll compressor including a protecting device which is able to control temperature in the compressor, as well as to control pressure in the compressor.

2. Description of the Background Art

Generally, various types of compressors can be used according to compressing methods, and a scroll compressor is mainly used for an air conditioner which needs to be small and light weight.

FIG. 1 is a cross-sectional view showing a scroll compressor including a pressure protecting device according to the conventional art.

The scroll compressor according to the conventional art comprises: a casing 106 having a hermetic space and connected a suction pipe 102 for sucking a fluid and a discharge pipe 104 are for discharging compressed fluid respectively; a driving unit 108 disposed on a lower part of the casing 106 for generating a driving force; and a compressed unit 110 disposed on an upper part of the casing 106 and connected to the driving unit 108 by a rotating shaft 112 for compressing the fluid sucked through the suction pipe 102 and for discharging the compressed fluid to the discharging pipe 104.

A supporting frame 114 for supporting the rotating shaft 112 to be rotatable and supporting the compressed unit 110 is installed in the casing 106, and a separating panel 120 is installed in the casing 106 to divide the inner area of the casing 106 into a first chamber 116 for maintained a low pressure state and a second chamber 118 for maintained a high pressure state.

The driving unit 108 comprises a stator 122 fixed toward a boundary direction of the casing 106, and a rotor 124 disposed on an inner circumferential surface of the stator 122 and fixed on the rotating shaft 112. In addition, when an electric power is applied to the stator 122, the rotor 124 is rotated by an interaction between the stator 122 and the rotor 124 to rotate the rotating shaft 112.

The compressed unit 110 includes a fixed scroll 128 having a fixed vane 126 of an involute form and fixed on the separating panel 120; and an orbiting scroll 132 having an orbiting vane 130 of an involute form corresponding to the fixed vane 126 so that a predetermined compressing chamber is formed between the fixed vane 126 and the orbiting vane 130, supported by the supporting frame 114 so as to orbit and orbited when the rotating shaft rotates.

A discharging passage 136 through which the fluid compressed by the interaction between the fixed vane 126 and the orbiting vane 130 is discharged toward the second chamber 118 is formed on a center part of the fixed scrolled 128, and a check valve 138 for preventing the fluid discharged into the second chamber 118 from flowing backward the first chamber 116 is installed on an upper part of the discharging passage 136.

The check valve 138 includes a valve body 142, which is fixed on a central upper end of the fixed scroll 128 on which the discharging passage 136 is formed and has a penetrated center part so as to be connected to the discharging passage 136, and a valve member 144 of a piston type inserted on an inner side of the valve body 142 so as to move in up-and-down direction for blocking the discharging passage 136 by the self weight.

In addition, a pressure protecting device (A) for by-passing the fluid of high pressure in the second chamber 118 to the first chamber 116 in case that the pressure difference between the first and the second chambers 116 and 118 is larger than a predetermined value or in case that the pressure in the first chamber 116 is too low is installed on one side of the separating panel 120.

As shown in FIG. 2, the pressure protecting device (A) comprises: a cylinder 150 for connecting the first chamber 116 and the second chamber 118; a piston 152 for opening/closing the cylinder 150 as moving in up-and-down direction inside the cylinder 150; and a spring 154 disposed between one side surface of the piston 152 and the inner wall of the cylinder 150 for providing the piston 152 with a certain elastic force.

The cylinder 150 is fixed on one side of the separating panel 120, and bypass flow passages 156 through which the fluid of high pressure in the second chamber 118 is by-passed to the first chamber 116 are formed on an upper and lower parts of the cylinder 150.

The upper surface of the piston 152 is disposed to adhere to the bypass flow passage 156, and the elastic member 154 is disposed between the lower surface of the piston 152 and the inner wall of the cylinder 150 to provide the piston 152 with the elastic force by which the bypass flow passage 156 is closed.

Operation of the pressure protecting device in the scroll compressor according to the conventional art will be described as follows.

FIG. 3 is a view showing an operational status of the pressure protecting device in the scroll compressor according to the conventional art.

In case that the operational range of the compressor is normal, when the electric source is applied to the driving unit 108, the rotating shaft 112 rotates to orbit the orbiting scroll 132, and the fluid sucked into the first chamber 116 through the suction pipe 102 is compressed by the interaction between the orbiting vane 130 and the fixed vane 126. In addition, the compressed fluid is flowed into the second chamber 118 and discharged to outer side through the discharging pipe 104.

During the operation of the compressor as described above, if the pressure difference between the first chamber 116 and the second chamber 118 is larger than a predetermined value or if the pressure in the first chamber 116 is lower than a predetermined level, the pressure protecting device is operated to provide the first chamber 116 with the fluid of high pressure in the second chamber 118, and thereby, the pressure difference between the first chamber 116 and the second chamber 118 is maintained to be an appropriate level.

That is, when the pressure difference between the first chamber 116 and the second chamber 118 becomes larger than pre-set value, the piston 152 moves downward as overcoming the elastic force of the spring 154 by the pressure of the high pressure fluid in the second chamber 118. Then, the bypass flow passage 156 is opened, and the fluid of high pressure in the second chamber 118 is by-passed to the first chamber 116 to maintain the pressure of the fluid in the first and second chambers 116 and 118 to be the set status.

FIG. 4 is a cross-sectional view showing a state that a temperature protecting device is installed on the scroll compressor according to the conventional art, and FIG. 5 is a cross-sectional view showing the temperature protecting device according to the conventional art.

The temperature protecting device (B) comprises: a bypass hole 170 penetrating between the first chamber 116 and the second chamber 118 formed on one side of the separating panel 120; a thermo-disk 172 disposed on an upper surface of the bypass hole 170; and a cover 174 for supporting both ends of the thermo-disk 172 fixed in the boundary direction of an upper part of the bypass hole 170. Herein, the thermo-disk is formed as overlapping two members having different thermal deformation rates, and a through hole 176 through which the fluid passes is formed on an upper part of the cover 174.

FIG. 6 is a view showing an operational status of the temperature protecting device according to the conventional art.

The temperature protecting device (B) maintains the state that the thermo-disk 172 blocks the bypass hole 170 when the compressor is normally operated, and when the temperature in the second chamber 118 is larger than a set value, the thermo-disk is distorted by the heat to open the bypass hole 170. Then the fluid in the second chamber 118 is by-passed to the first chamber 116 through the bypass hole 170 to decrease the temperature in the second chamber 118. At that time, when the temperature becomes lower than the set value, the thermo-disk is returned to the original state to block the bypass hole 170.

However, according to the protecting device in the scroll compressor of the conventional art, in case that only the pressure protecting device is installed, the protection according to the temperature change in the compressor can not be made. In addition, when only the temperature compensating device is installed, the protection according to the pressure change in the compressor can not be made. In case that the pressure and the temperature protecting devices are disposed, the structure of the compressor becomes complex and the production cost is increased.

Also, according to the conventional pressure protecting device, when the piston is moved by the pressure difference between the first and the second chambers and the bypass flow passage is opened, the fluid of high pressure in the second chamber is by-passed to the first chamber at once. Therefore, the pressure in the first chamber is risen rapidly, and thereby, the reliability of the compressor is lowered and an error may be generated.

SUMMARY OF THE INVENTION

Therefore, an object of the present invention is to provide a scroll compressor which can be protected when the compressor is in abnormal pressure or abnormal temperature status, and of which a structure can be made simple and production cost can be reduced.

Another object of the present invention is to provide a scroll compressor by which a phenomenon that an internal pressure is changed rapidly can be reduced, and thereby a reliability of the compressor is improved and a damage in the compressor can be prevented.

To achieve these and other advantages and in accordance with the purpose of the present invention, as embodied and broadly described herein, there is provided a sealed casing including a first chamber for forming low pressure and a second chamber for forming high pressure which are divided by a separating panel; a driving unit built-in the casing for generating a driving force; a compressed unit connected to the driving unit via a rotating shaft for compressing and discharging fluid when the driving unit is operated; and a protecting device installed on one side of the separating panel for by-passing the fluid of high pressure or high temperature in the second chamber to the first chamber when a pressure difference or a temperature difference between the first and the second chambers becomes larger than a set value.

The protecting device in the scroll compressor according to the present invention comprises: a shell which fixed on one side of the separating panel so as to connect the first chamber and the second chamber and includes an suction passage and a discharging passage formed on an upper and a lower parts; a thermal deformation member disposed in the shell so as to be moved in up-and-down direction for opening/closing the suction passage; and an elastic member disposed between a lower surface of the thermal deformation member and an inner wall surface of the shell for providing the thermal deformation member with a certain elastic force.

The shell in the scroll compressor according to the present invention is fixed on a through hole formed on one side of the separating panel, a plurality of suction passages through which the fluid of high pressure in the first chamber is flowed are formed on an upper surface of the shell located on the first chamber side, and a discharging passage through which the fluid passed through the shell is discharged toward the first chamber is formed on a lower surface which is located on the second chamber side.

The upper surface of the shell in the scroll compressor according to the present invention is formed concavely, that is, the center part of the shell is depressed.

The shell in the scroll compressor according to the present invention is formed as a cone in which an area through which the fluid passes is enlarged as going to the first chamber from the second chamber.

The thermal deformation member in the scroll compressor according to the present invention is formed as a concave plate so as to adhere to the suction passage of the shell and to close the suction passage, and formed using a material which is distorted when it is heated more than a predetermined level.

The elastic member in the scroll compressor according to the present invention is formed as a conical coil spring.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments for a scroll compressor according to the present invention, and the most preferred embodiment will be described.

Figure 1:
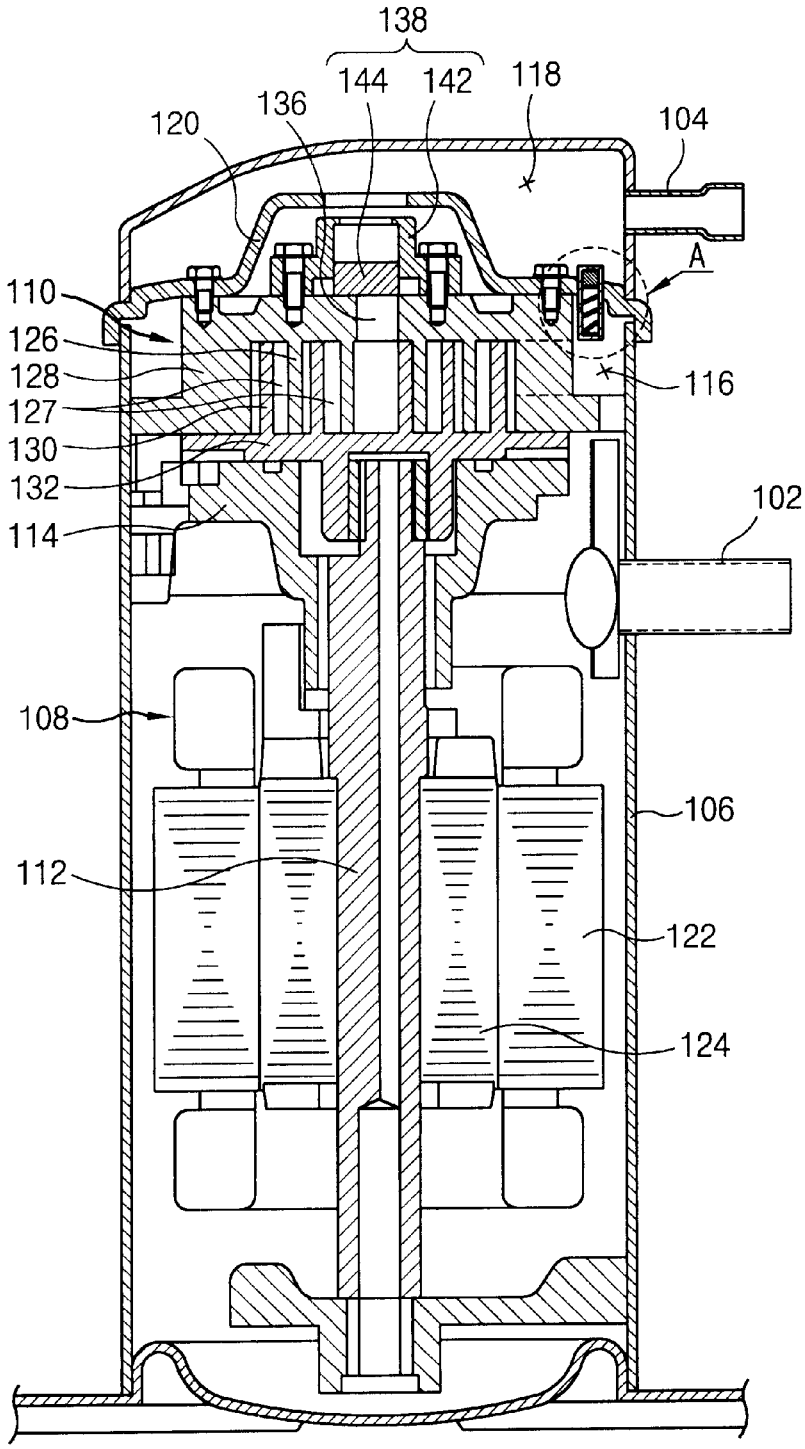
FIG.1 CONVENTIONAL ART
FIG. 1 is a cross-sectional view showing a scroll compressor including a pressure protecting device according to the conventional art.
Figure 2:
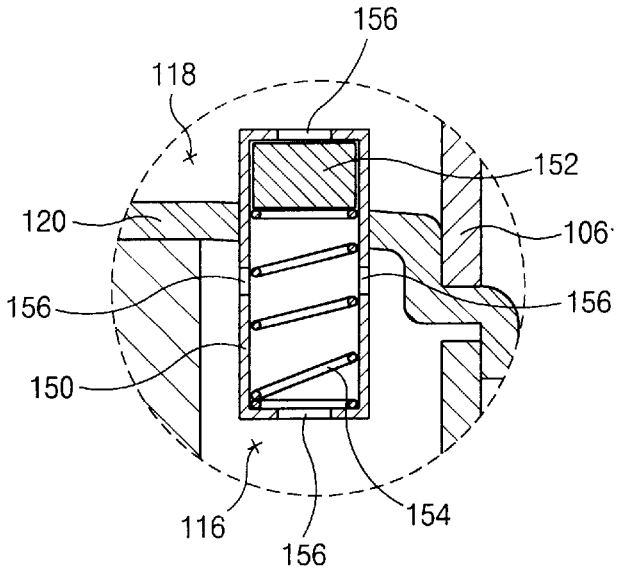
FIG.2 CONVENTIONAL ART
FIG. 2 is an enlarged view showing part A in FIG. 1, that is, the pressure protecting device in the scroll compressor according to the conventional art.
Figure 3:
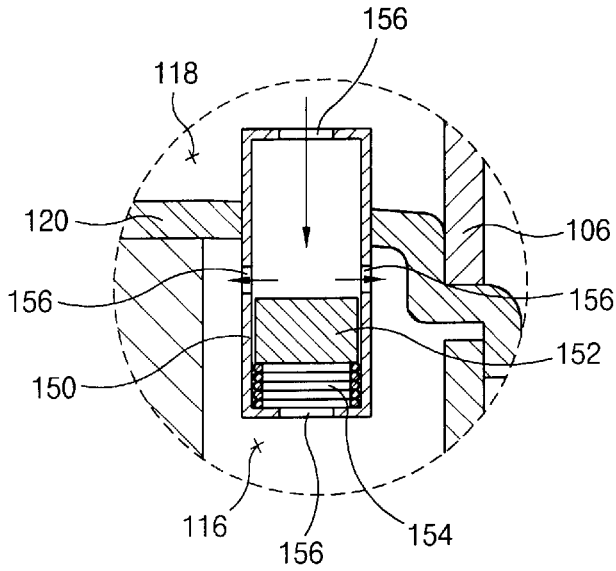
FIG.3 CONVENTIONAL ART
FIG. 3 is a view showing an operational status of the pressure protecting device according to the conventional art.
Figure 4:
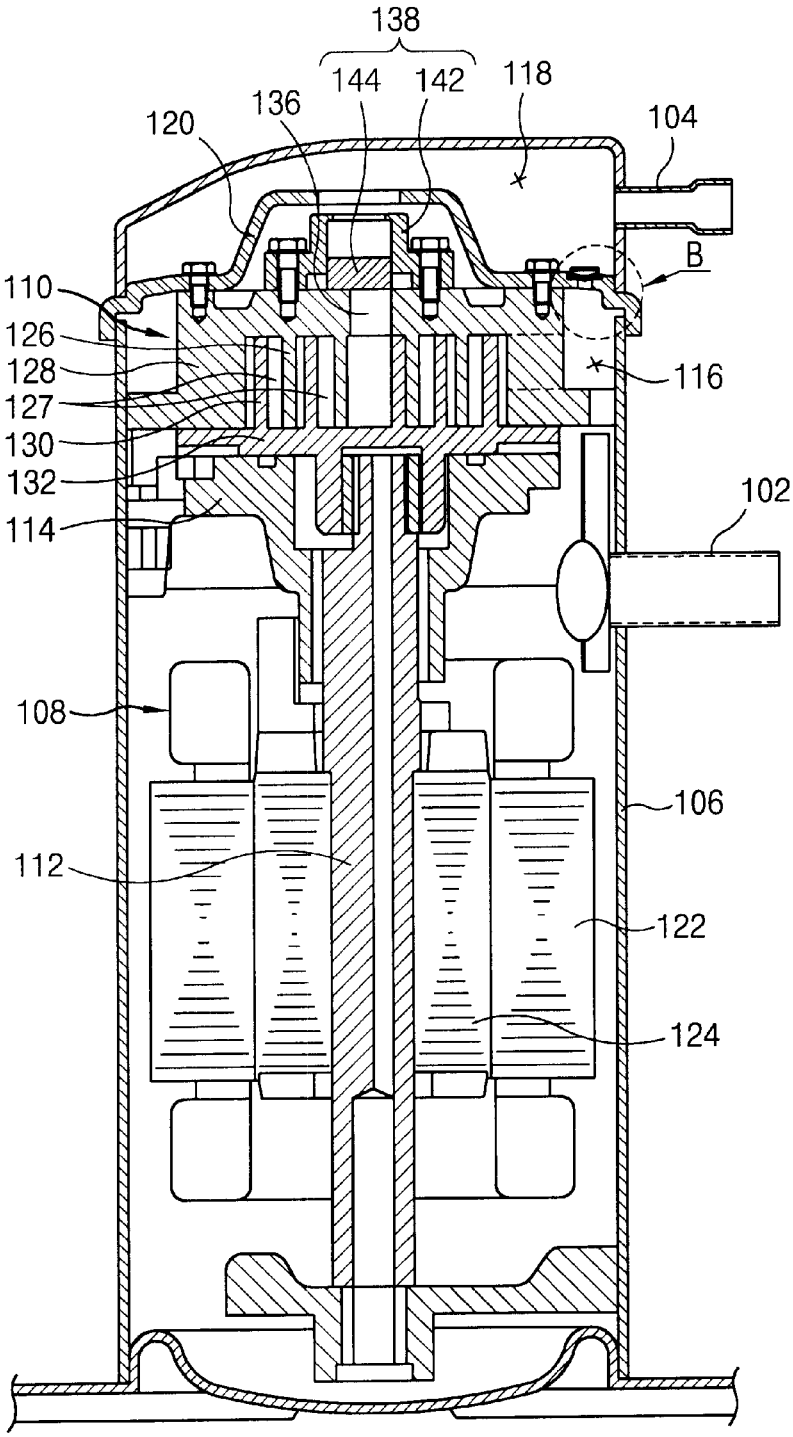
FIG.4 CONVENTIONAL ART
FIG. 4 is a cross-sectional view showing a scroll compressor comprising a temperature protecting device according to the conventional art.
Figure 5:
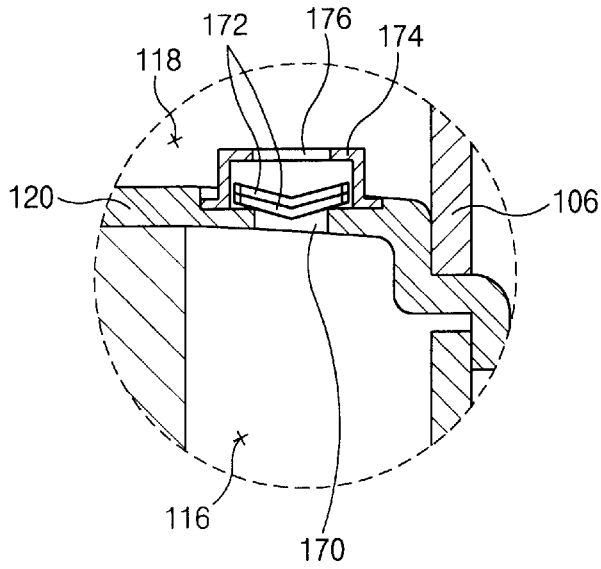
FIG.5 CONVENTIONAL ART
FIG. 5 is an enlarged view showing part B in FIG. 4, that is, the temperature protecting device in the scroll compressor according to the conventional art.
Figure 6:
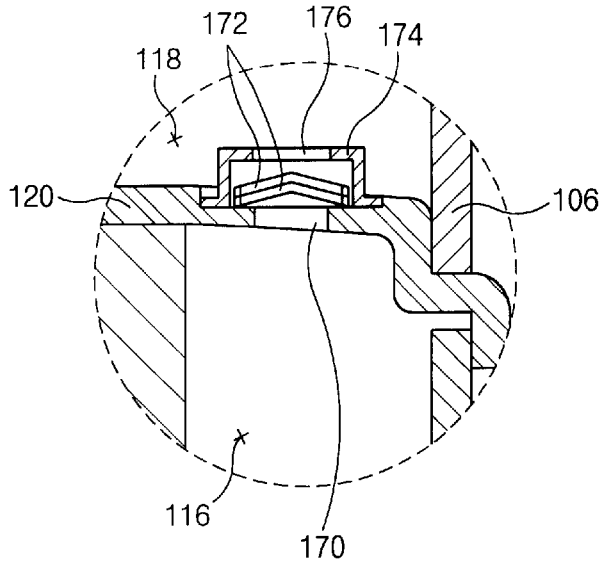
FIG.6 CONVENTIONAL ART
FIG. 6 is a view showing an operational status of the temperature protecting device in the scroll compressor according to the conventional art.
Figure 7:
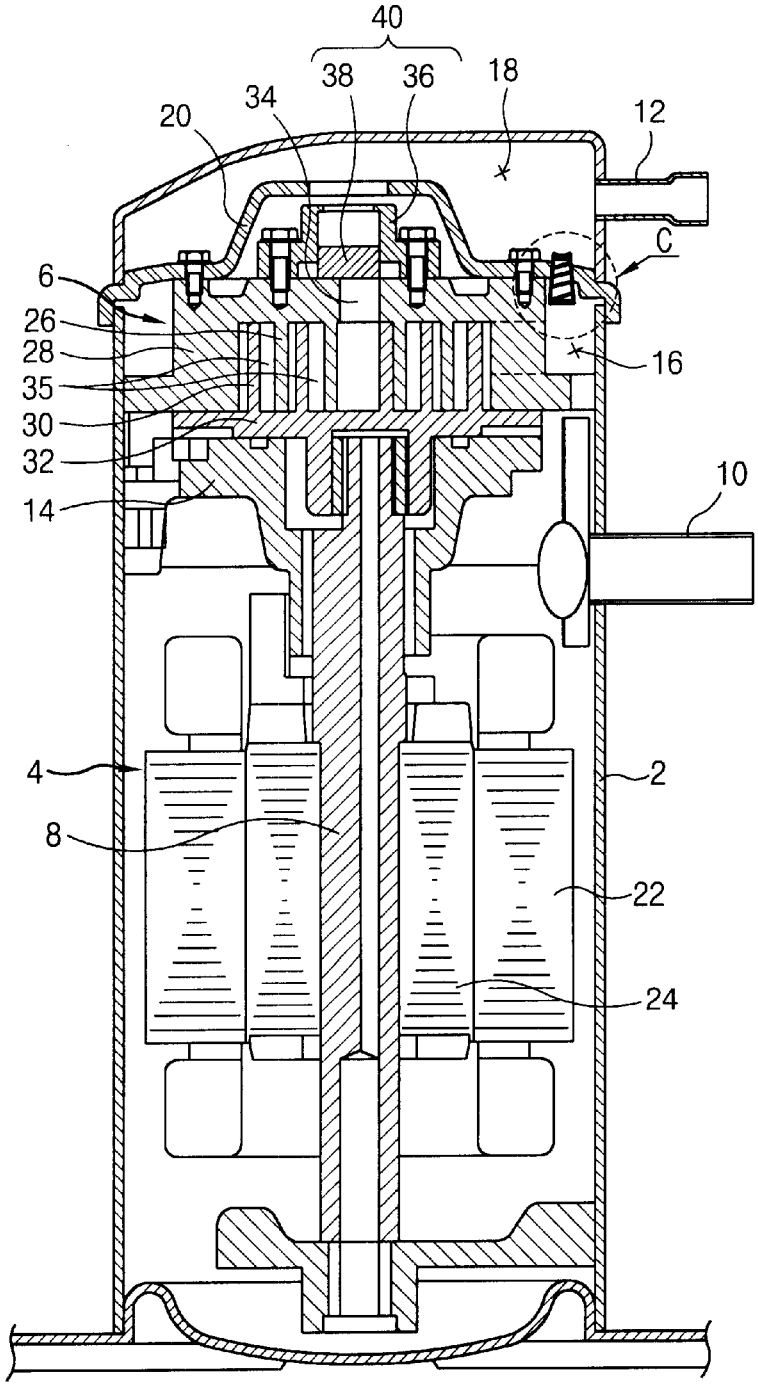
FIG. 7 is a cross-sectional view showing a scroll compressor according to the present invention.

FIG. 4 is a cross-sectional view showing a scroll compressor comprising a protecting device according to the present invention.

The scroll compressor according to the present invention comprises: a casing 2 having a hermetic space; a driving unit 4 built-in the casing 2 for generating a driving force; a compressed unit 6 connected to the driving unit 4 via a rotating shaft 8 for compressing and discharging fluid when the driving unit 4 is operated; and a protecting device installed on one side of the compressed unit 6 for protecting the compressor in case that an abnormal pressure or an abnormal temperature is generated in the compressor.

A suction pipe 10 through which the fluid is sucked and a discharge pipe 12 through which the compressed fluid is discharged are connected to one side of the casing 2. In addition, a supporting frame 14 for supporting the rotating shaft 8 so as to be rotatable and for supporting the compressed unit 6, and a separating panel 20 for dividing inside of the casing 2 into a first chamber 16 connected to the suction pipe 10 for maintaining a lower pressure state and a second chamber 18 connected to the discharge pipe 12 for maintained a high pressure state are installed in the casing 2.

The driving unit 4 comprises a stator 22 fixed on an inner circumferential surface of the casing 2; and a rotor 24 disposed on an inner circumferential surface of the stator 22 and fixed on the rotating shaft 8. In addition, when the electric source is applied to the stator 22, the rotor 24 is rotated by an interaction between the stator 22 and the rotor 24 to rotate the rotating shaft 8.

The compressed unit 6 comprises: a fixed scroll 28 including a fixed vane 26 of an involute shape and fixed on the separating panel 20; and an orbiting scroll 32 including an orbiting vane 30 of involute shape which is corresponded to the fixed vane 26 so that a certain compressing space 35 is formed between the fixed vane 26 and the orbiting vane 30, and supported by the supporting panel 14 so as to orbit when the rotating shaft 8 rotates.

A discharge hole 34 through which the compressed fluid is discharged to the second chamber 18 by the interaction between the fixed vane 26 and the orbiting vane 30 is formed on a center part of the fixed scroll 28, and a check valve 40 for preventing the fluid from being flowed backward by opening/closing the discharge hole 34 is installed on an upper side surface of the fixed scroll 28.

The check valve 40 includes: a valve body 36, on which a center part is penetrated so as to connect to the discharge hole 34, fixed on an upper central side of the fixed scroll 28 where the discharge hole 34 is formed; and a valve member 38 disposed on an inner side of the valve body 36 so as to be moved in up-and-down direction for blocking the discharge hole 34 by a self weight.

Figure 8:
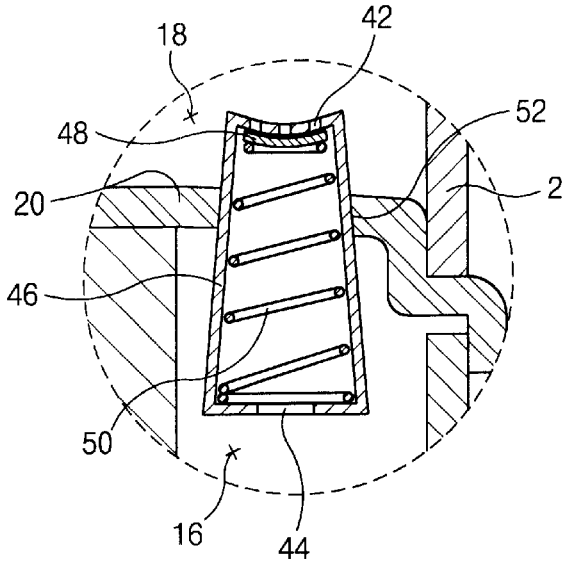
FIG. 8 is an enlarged view showing part C in FIG. 7, that is, a protecting device in the scroll compressor according to the present invention.

As shown in FIG. 8, the protecting device comprises: a shell 46 fixed on one side of the separating panel 20 so as to penetrate the first chamber 16 and the second chamber 18; a thermal deformation member 48 disposed in the shell 46 so as to move in up-and-down direction for opening/closing the suction passage 42; and an elastic member 52 disposed between a lower surface of the thermal deformation member 48 and an inner wall surface of the shell 46 for providing the thermal deformation member 48 with a certain elastic force.

The shell 46 is formed as a cone having a predetermined length fixed on a through hole 52 penetrating the first chamber 16 and the second chamber 18 formed on one side of the separating panel 20, and an inner diameter of the shell 46 is gradually increased from the second chamber 18 toward the first chamber 16.

In addition, a, plurality of suction passages 42 through which the fluid of high pressure in the second chamber 18 is flowed are formed on an upper surface of the shell 46 having small diameter which is located in the second chamber 18 side, and a discharge passage 44 through which the fluid passed through the shell 46 is discharged to the first chamber 16 is formed on a lower surface of the shell 46 having larger diameter located in the second chamber 18. Herein, the upper surface of the shell 46 on which the suction passages 42 are formed is formed to be concave.

As described above, the shell 46 has a structure that the inner diameter through which the fluid passes is increased gradually from the second chamber 18 toward the first chamber 16. Thereby, when the fluid in the second chamber 18 passes the suction passage 42, the pressure of the fluid is very high. However, when the fluid is discharged through the discharge passage 44, the pressure of the fluid is low because the pressure of the fluid is decreased by passing through the shell 46. Therefore, a sudden change in the pressure of the fluid can be reduced.

The thermal deformation member 48 is formed as a plate having a concave center part so as to adhere to an upper inner side of the shell 46 and to open/close the suction passage 42. In addition, the thermal deformation member 48 blocks the suction passage 42 by the elastic force of the elastic member 50, and opens the suction passage 42 by overcoming the elastic force of the elastic member 50 and moving downward when the pressure difference between the first chamber 16 and the second chamber 18 increases.

In addition, it is desirable that the thermal deformation member 48 is formed as a bimetal type in which the concave part is protruded by the self distortion when it is heated more than a predetermined level.

That is, the concave part which blocks the suction passage 42 of the thermal deformation member 48 is protruded to open the suction passage 42 when the temperature in the second chamber 18 rises higher than the set level. In addition, the fluid of high temperature in the second chamber 18 is discharged into the first chamber 16 to maintain the temperature in the second chamber 18 to be an appropriate level.

It is desirable that the elastic member 50 is formed as a conical coil spring disposed between the lower side surface of the thermal deformation member 48 and the inner wall surface of the shell 46. In addition, the elastic member 50 is formed to have a predetermined elastic force compressed when the pressure difference between the first chamber 16 and the second chamber 18 is the set value or more.

Operation of the protecting device for the scroll compressor according to the present invention will be described as follows.

In case that the compressor is in a normal operation status, when the electric power is applied to the driving unit 4, the rotating shaft 8 is rotated and the orbiting scroll 32 is orbited by the rotation of the rotating shaft 8. Therefore, the fluid which is sucked into the compression space 35 is compressed and discharged to the second chamber 18 through the discharging hole 34. Then, the fluid of high pressure flowed into the second chamber 18 is discharged outward through the discharging pipe 12.

At that time, the check valve 40 mounted on the discharging hole 34 prevents the fluid which is discharged into the second chamber 18 from being flowed backward to the first chamber 16.

During the operation of the scroll compressor, if the pressure in the second chamber 18 is larger than a predetermined level comparing to the pressure in the first chamber 16, or if the pressure in the first chamber 16 is smaller than the predetermined level comparing to the pressure in the second chamber 18, the protecting device is operated to by-pass the fluid of high pressure in the second chamber 18 to the first chamber 16, and thereby the pressures in the first chamber 16 and in the second chamber 18 are maintained to be appropriate levels.

Figure 9:
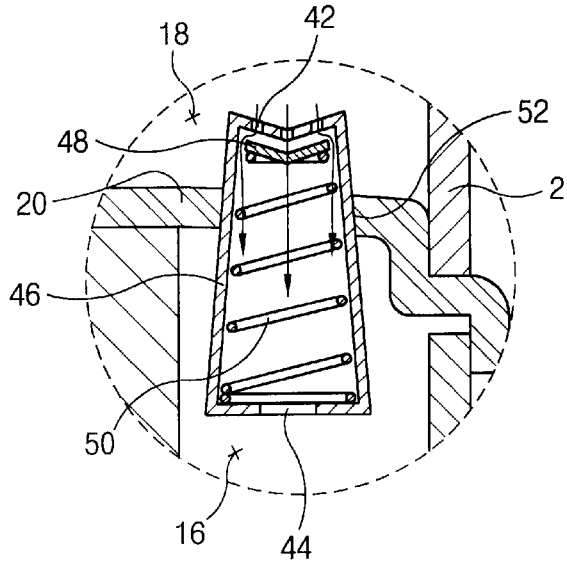
FIGS. 9 and 10 are views showing operational states of the protecting device in the scroll compressor according to the present invention.

That is, as shown in FIG. 9, when the pressure difference between the first chamber 16 and the second chamber 18 is larger than a set level, the thermal deformation member 48 overcomes the elastic force of the elastic member 50 and moves downward by the pressure difference between the two chambers 16 and 18 to open the suction passage 42 formed on the upper part of the shell 46. Then, the fluid of high pressure in the second chamber 18 is flowed into the suction passage 42, passes the shell 46, and is by-passed to the first chamber 16 through the discharge passage 44 formed on the lower part of the shell 46.

At that time, because the inner diameter of the shell 46 is gradually enlarged toward the first chamber 16, the fluid of high pressure is depressed a certain degree as passing through the shell 46 and provided to the first chamber, and therefore, the sudden changed in the pressure can be prevented.

In addition, when the temperature in the second chamber 18 rises higher than the set temperature during the operation of the scroll compressor, the protecting device is operated, and thereby the fluid of high temperature in the second chamber 18 is bypassed to the first chamber 16 to maintain the temperature in the second chamber 18 to be an appropriate level.

Figure 10:
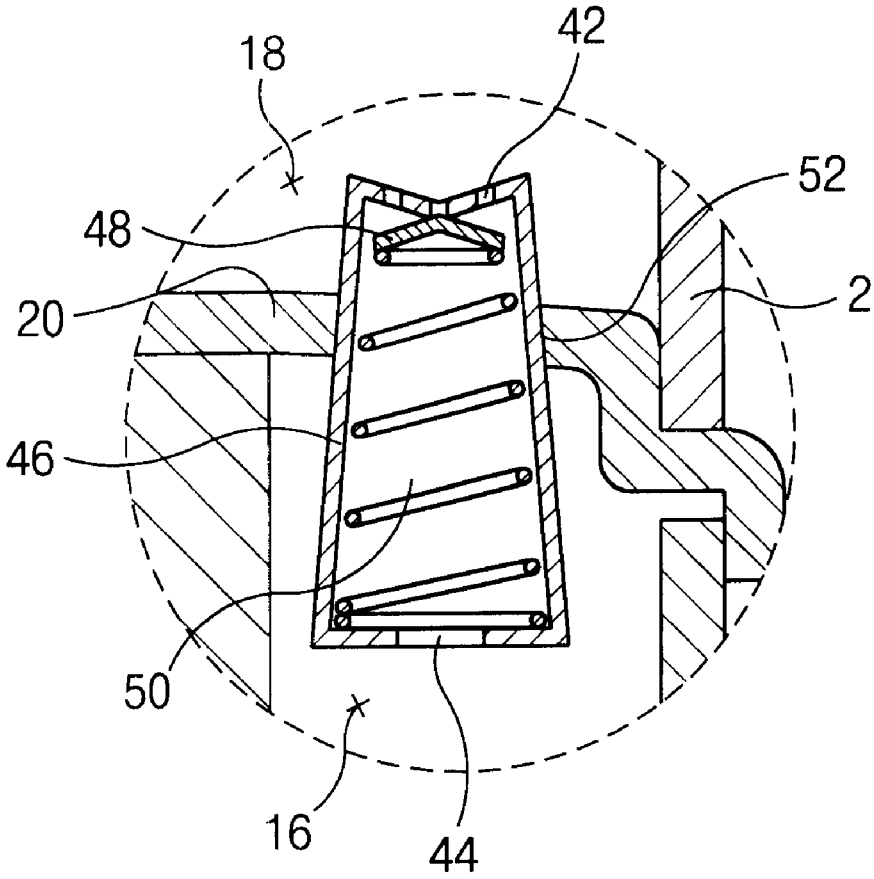

That is, as shown in FIG. 10, when the temperature in the second chamber 18 rises, the concave part of the thermal deformation member 48 is discharged to be convex shape to open the suction passage 42. Then, the fluid of high temperature in the second chamber 18 is discharged into the first chamber 16, and thereby the temperature in the second chamber 18 is decreased. At that time, the temperature in the second chamber 18 becomes the appropriate level, the thermal deformation member 48 is returned to the original state to block the suction passage 42.

Effect of the scroll compressor which is constructed and operated as described above will be described as follows.

During the operation of the scroll compressor, when the pressure difference between the first chamber and the second chamber becomes larger than the set level, the thermal deformation member overcomes the elastic force of the elastic member and opens the suction passage to maintain the pressure to be the appropriate level. In addition, when the temperature in the second chamber is larger than the set temperature, the thermal deformation member is distorted to open the suction passage of the shell, and thereby the fluid of high temperature in the second chamber is bypassed to the first chamber to maintain the temperatures in the first chamber and in the second chamber to be appropriate levels. Therefore, the damage of the compressor caused by the pressure and temperature change can be prevented, and the reliability of the compressor can be improved.

Also, the pressure and the temperature are controlled at the same time using one protecting device, and therefore, the installation space in the compressor can be reduced, the structure can be simplified, and the production cost can be reduced.

Also, the area in the shell where the fluid passes is enlarged gradually from the second chamber toward the first chamber, and therefore, the pressure of the fluid discharged from the second chamber is depressed at a certain degree as passing through the shell, and then, discharged into the first chamber. Therefore, the sudden change in the pressure can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a hermetic casing including a first chamber for forming a low pressure and a second chamber for forming a high pressure which are divided by a separating panel;

a driving unit mounted in the casing for generating a driving force;

a compressor unit connected to the driving unit via a rotating shaft for compressing and discharging fluid when the driving unit is operated; and a protecting device responsive to the temperature and pressure of the fluid and mounted at the separating panel for bypassing the fluid of high pressure or of high temperature in the second chamber to the first chamber when a pressure difference or temperature difference between the first and second chambers is larger than a set value.

2. The compressor of claim 1, wherein the protecting device comprises:

a shell including suction passage and a discharge passage on upper and lower parts and fixed to the separating panel;

a thermal deformation member disposed in the shell to move in up-and-down direction for opening/closing the suction passage; and an elastic member disposed between a lower side surface of the thermal deformation member and an inner wall surface of the shell for providing the thermal deformation member with a predetermined elastic force.

3. The compressor of claim 2, wherein the shell is fixed in a through hole which is formed at the separating panel, a plurality of suction passages through which the fluid of high pressure in the second chamber passes are formed on an upper surface of the shell located in the second chamber, and the discharge passage through which the fluid passes is formed on a lower surface of the shell located in the first chamber.

4. The compressor of claim 2, wherein the upper surface of the shell is formed to be concave, that is, a center part is sunken.

5. The compressor of claim 2, wherein the shell is formed as a cone in which an area through which the fluid passes is increased gradually from the second chamber toward the first chamber.

6. The compressor of claim 2, wherein the thermal deformation member 48 is formed as a concave plate so as to adhere to the suction passage of the shell and close the suction passage, and is formed using a material which is distorted its body when it is heated by the heat higher than a predetermined level.

7. The compressor of claim 2, wherein the elastic member is formed as a conical coil spring.

8. The compressor of claim 3, wherein the upper surface of the shell is formed to be concave, that is, a center part is sunken.

9. The compressor of claim 3, wherein the shell is formed as a cone in which an area through which the fluid passes is increased gradually from the second chamber toward the first chamber.

* * * * *